US009522339B2

(12) United States Patent
Ngai

(10) Patent No.: US 9,522,339 B2
(45) Date of Patent: Dec. 20, 2016

(54) TOY SLOT CAR WITH PROTECTIVE COVER FOR CONDUCTIVE ELEMENTS

(71) Applicant: ARTIN INTERNATIONAL LIMITED, Hong Kong (CN)

(72) Inventor: Kam Fai Ngai, Hong Kong (CN)

(73) Assignee: Artin International Limited, Hong Kong (CN)

( * ) Notice: Subject to any disclaimer, the term of this patent is extended or adjusted under 35 U.S.C. 154(b) by 0 days.

(21) Appl. No.: 14/898,685

(22) PCT Filed: Apr. 3, 2014

(86) PCT No.: PCT/CN2014/074699

§ 371 (c)(1),
(2) Date: Dec. 15, 2015

(87) PCT Pub. No.: WO2014/201894

PCT Pub. Date: Dec. 24, 2014

(65) Prior Publication Data

US 2016/0129357 A1 May 12, 2016

(30) Foreign Application Priority Data

Jun. 17, 2013 (HK) ..... 13107071

(51) Int. Cl.
*A63H 17/00* (2006.01)
*A63H 18/12* (2006.01)
(Continued)

(52) U.S. Cl.
CPC ..... *A63H 17/262* (2013.01); *A63H 18/08* (2013.01); *A63H 18/12* (2013.01)

(58) Field of Classification Search
CPC ..... A63H 18/12; A63H 18/08; A63H 17/262
(Continued)

(56) References Cited

U.S. PATENT DOCUMENTS 3,379,138 A * 4/1968 Lindstrom ..... A63H 18/12 104/288
3,453,970 A * 7/1969 Hansen ..... A63H 18/12 104/302

(Continued)

FOREIGN PATENT DOCUMENTS

CN 2362559 Y 2/2000
CN 1666806 A 9/2005

(Continued)

*Primary Examiner* — Alexander Niconovich
(74) *Attorney, Agent, or Firm* — Finnegan, Henderson, Farabow, Garrett & Dunner, LLP

(57) ABSTRACT

A slot car comprises a chassis (110), a motor mounted on the chassis (110) for driving the slot car and a plurality of conductive elements (101, 102) exposed on the chassis (110) which is electrically connected to the motor for driving the slot car. The slot car further comprises a cover (100) covering at least a portion of the conductive elements (101, 102) and which is adapted to restrict the conductive elements (101, 102) from bending and dislocating. The conductive elements (101, 102) may be in form of metal brush (101, 102). The cover (100) is formed with a slanted surface so that the angle between the chassis (110) and the conducting elements (101, 102) does not exceed 7 degree and is further provided with guide members (106, 107). Such guide members (106, 107) restrict the lateral displacements of the conductive elements (101, 102). Moreover, the cover (100) may be integrally formed with the chassis (110), or may be provided with fastening means (103, 104) for attached removably to the chassis (110).

13 Claims, 2 Drawing Sheets

(51) Int. Cl.
*A63H 17/26* (2006.01)
*A63H 18/08* (2006.01)

(58) Field of Classification Search
USPC ..... 446/444, 446, 454, 455, 460; 104/60, 104/304, 305
See application file for complete search history.

(56) References Cited

U.S. PATENT DOCUMENTS 3,581,668 A * 6/1971 Ingels ..... A63H 30/02 104/304
3,596,397 A * 8/1971 Colletti ..... A63H 18/12 446/446
3,774,340 A * 11/1973 Barlow ..... A63H 18/16 104/304
4,141,553 A * 2/1979 Beny ..... A63H 18/12 104/300
4,156,987 A * 6/1979 Lahr ..... A63H 18/12 104/304
4,187,637 A * 2/1980 Nielsen ..... G09B 9/048 446/444
4,200,287 A * 4/1980 Ryan ..... A63H 17/36 104/304
4,231,183 A * 11/1980 Lahr ..... A63H 18/12 104/304
4,254,577 A * 3/1981 Cheng ..... A63H 18/16 104/304
4,386,777 A * 6/1983 Prehodka ..... A63H 18/028 104/281
4,415,157 A * 11/1983 Lahr ..... A63H 18/12 104/304
4,453,712 A * 6/1984 Lee ..... A63H 18/12 104/304
4,479,650 A * 10/1984 Neuhierl ..... A63H 18/12 104/304
4,643,102 A * 2/1987 Arnau Manresa ..... A63H 18/12 104/305
4,892,502 A * 1/1990 Hesse ..... A63H 17/262 446/444
4,940,444 A * 7/1990 Russell ..... A63H 18/12 104/281
5,006,090 A * 4/1991 Kennedy ..... A63H 18/12 446/457
5,075,515 A * 12/1991 Yoneda ..... A63H 18/02 191/22 C
5,127,869 A * 7/1992 Hanzawa ..... A63F 3/0421 434/169
5,342,048 A * 8/1994 Jones ..... A63F 9/143 446/444
5,928,058 A * 7/1999 Francis ..... A63H 17/36 446/446
6,102,770 A * 8/2000 Cyrus ..... A63H 18/00 446/129
7,090,556 B2 * 8/2006 Maleika ..... A63H 18/08 104/242
7,445,540 B2 * 11/2008 Reuter ..... A63H 18/08 446/444
7,601,068 B1 * 10/2009 McGee ..... A63H 18/005 446/435
7,637,797 B2 * 12/2009 Dieckmann ..... A63H 17/36 446/444
8,257,136 B2 * 9/2012 Yu ..... A63H 17/21 446/310
8,262,431 B2 * 9/2012 Nakano ..... A63H 17/28 104/60
2004/0185747 A1 * 9/2004 Chiu ..... A63H 18/08 446/444
2014/0335759 A1 * 11/2014 Pyrdeck ..... A63H 18/16 446/446

FOREIGN PATENT DOCUMENTS

FR 2 340 756 9/1977
HK 1184013 A 1/2014

* cited by examiner

TOY SLOT CAR WITH PROTECTIVE COVER FOR CONDUCTIVE ELEMENTS

FIELD OF INVENTION

The present application relates to a toy vehicle with a detachable cover. Specifically, the present application relates to a slot car with detachable protective cover for covering the metal conductive brushes on slot cars to avoid damages and deformations of the metal brushes.

BACKGROUND OF INVENTION

A slot car is a powered miniature vehicle that is guided by a slot in a track which it runs on. Typically, a slot car is guided to run on the track by a pin extends from the bottom of the car into the slot. Traditionally, slot cars are powered by a DC power source on the track. A typical slot car may include a pair copper elements or metal brushes underneath the chassis for conducting electricity from track to the motor of the slot car. Shortcomings of using copper elements include but not limited to corrosions or rusting after prolonged period of use. Additionally, as the copper elements grind on the metal rails on the track, the same generates intense sparks which could hardly fulfill toys regulation requirements. As a result, slot cars with copper elements are obsolete nowadays.

Although the use of a pair of metal brushes on slot cars has greatly eliminated the problems of corrosion and sparking, the deformation and damages of the metal brush could not be avoided. As the metal brush is made by slender copper thread woven, it deforms very easily especially when the slot cars are being intentionally moved backwards or outside the designated track. It is an objective of the present invention to alleviate the above-mentioned issues by adding a protective cover to cover up a large portion of the metal brushes so as to reduce deformations and damages of the metal brushes.

SUMMARY OF INVENTION

According to the present application, there is provided a slot car including a chassis, a motor mounted on the chassis for driving the slot car and a plurality of conducting element exposed on the chassis which is electrically connected to the motor for driving the slot car. The slot car further includes a cover covering at least a portion of the conducting elements and the cover is adapted to restrict the conducting elements from bending and dislocating. The conducting elements may be in form of metal brush. The cover serves to restrict the conducting elements from bending away from the chassis.

The cover is formed with a slanted surface so that the angle between the chassis and the conducting element does not exceed 7 degree, and is further provided with guide members. Such guide members restrict the lateral displacements of the conducting elements. Moreover, the cover may be provided with fastening means for removably attached to the chassis, such as snap-on hooks. However, the cover may also be integrally formed with the chassis. The cover extends widthwise exceeding the overall widths of the conducting elements and further extends in the lengthwise direction of the conducting elements, covering at least ⅓ but less than half of the length of the conducting elements.

DETAILED DESCRIPTION

The present application relates to a slot car having a cover for protecting the metal conductive elements from deforming and damaging due to mistreat by the user during handling or operating the slot car.

According to the present application, a removable cover is provided on the underside of a slot car for covering a portion of the metal conductive elements, metal brushes as non-limiting example, in order to avoid deformation and damage of the same. The pair of metal brushes is the essential component of the slot car as it carries a direct electric current conducted continuously throughout the metal rails on the track to the motor in the slot car as it runs on the track. The metal brushes are the contact points for conducting electricity from the metal rails on the track to the slot car's motor and provide the power source to the slot car. They are engaged in a frictional contact with the metal rails as the slot car runs.

In order to maintain good frictional contact between the metal rails on the track and the metal brushes on the slot car, the metal brushes are shaped and situated so that the downward facing sides of the metal brushes are biased against the surface of the metal rails on the track. The metal brushes are extended lengthwise in the direction opposite to travel and are sufficiently long to reach from the chassis of the slot car to the surface of the metal rail on the track. The positions where the metal brushes are in contact with the metal rails on the track relied on the strength of the metal brushes themselves, that is, the ability for the metal brushes to retain in their positions. Due to the orientation of layout of the metal brushes and their flexibility, the slot car is not able to run in reverse as the metal brushes will likely be deformed and displaced.

Figure 1:
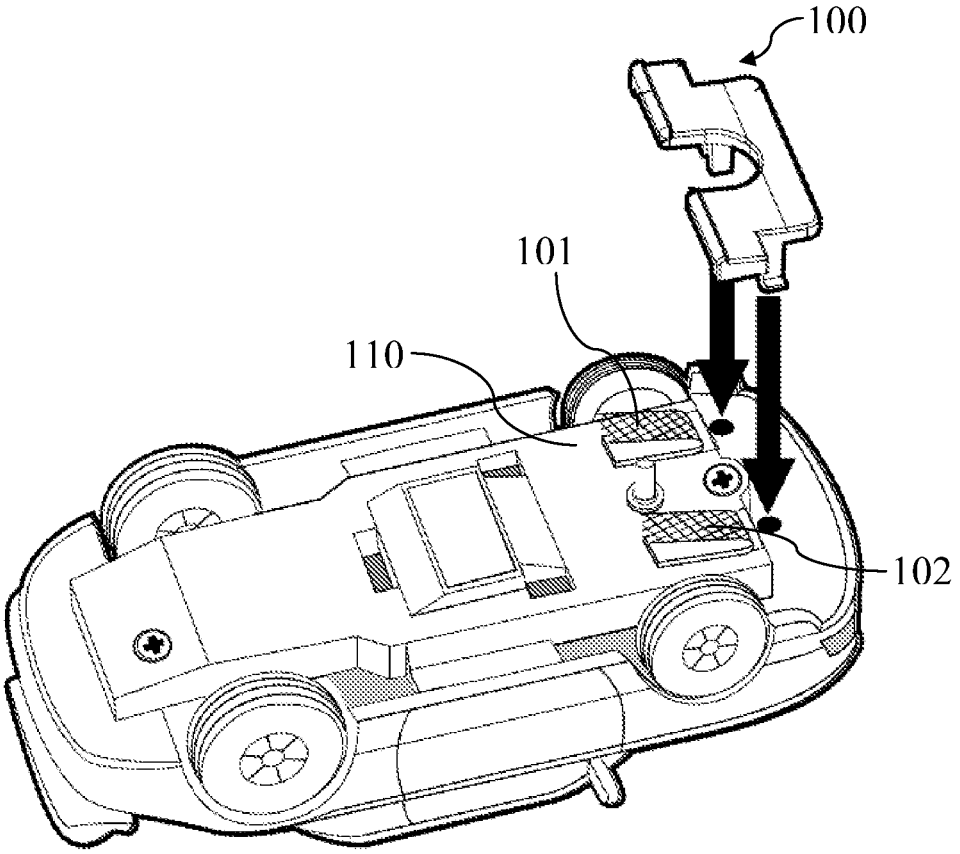
FIG. 1 shows a bottom perspective view of a slot car to be fitted with a protective cover of the present application.
Figures 2A, 2B:
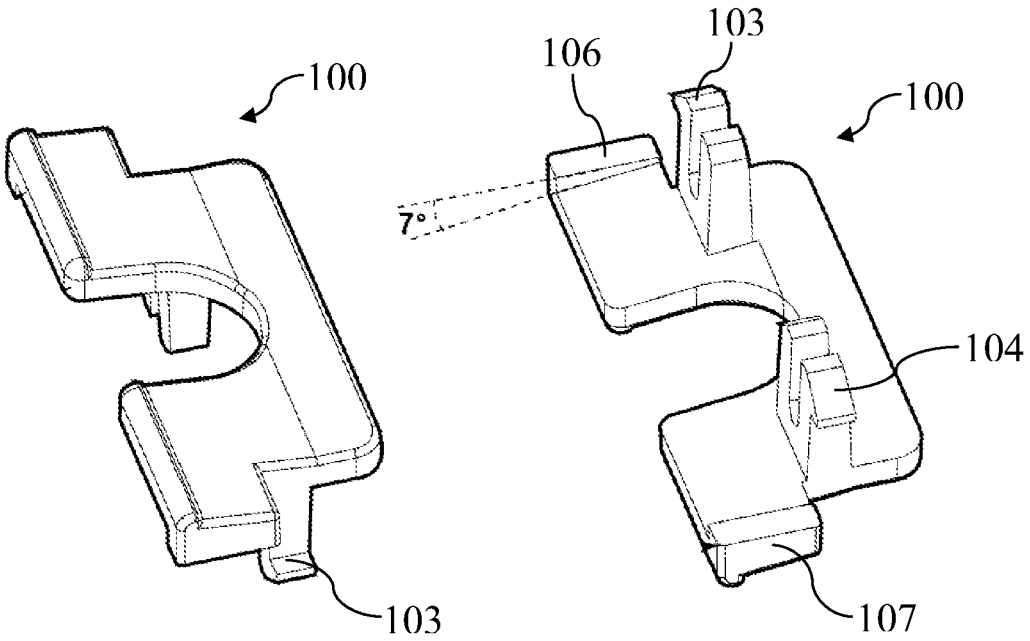
FIG. 2*a* shows a top perspective view of the protective cover of the present application.
FIG. 2*b* shows a bottom perspective view of the protective cover of the present application.

Referring to FIG. 1, the present application provides a cover 100 for preventing the metal brushes 101 & 102 to bend as well as maintaining their respective positions during frictional contact with the track. The cover 100 may be a plastic plate attached to the underside of the chassis 110 of the slot car. As an example, the cover may be removably attached to the underside of the chassis 110 by any fastening means, i.e., by snap-on hooks 103 & 104 as shown in FIGS. 2*a* and 2*b*. The cover 100 being detachable provides the ease in situation that worn metal brushes are to be serviced or replaced. However, the cover 100 may also be integrally formed with the chassis 110. Details of the cover 100 will be discussed in details in the following descriptions.

Figure 2C:
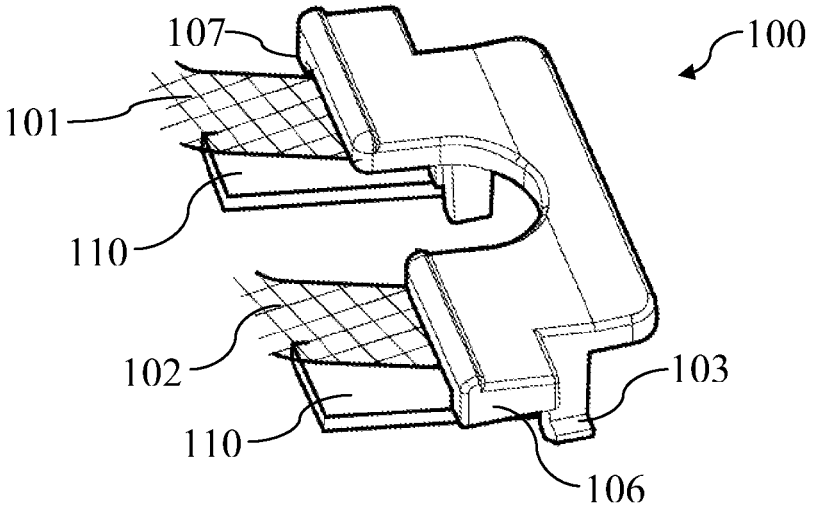
FIG. 2*c* shows a top perspective view of the protective cover of the present application installed on the chassis of a slot car.

The cover 100 to be used on a slot car for preventing deformations and damages of the metal brushes 101 & 102 may be formed as shape as shown in FIGS. 2*a* and 2*b*. The cover 100 essentially extends widthwise across the two metal brushes 101 & 102. On the other hand, the cover 100 only covers portions of the metal brushes 101 & 102 which are closest to the chassis 110. The cover 100 extends lengthwise in direction to cover about one third to half of the length of the metal brushes 101 & 102. This leaves a length of metal brushes exposed and in contact with the metal rails on the track as shown in FIG. 2*c*. Further, the above allows the metal brushes 101 & 102 to retain some degree of flex for better contact with the metal rails on the track. As the metal brushes 101 & 102 are initially bent and point towards the rear direction of the slot car, the cover 100 restricts the metal brushes 101 & 102 from being bent in the opposition direction.

Figure 3A:
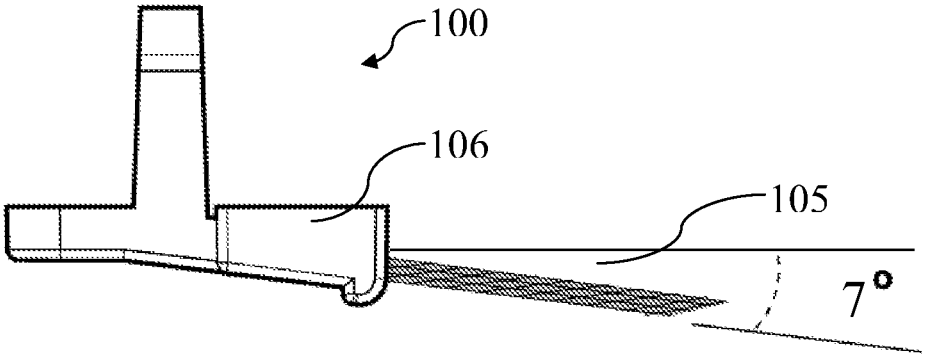
FIG. 3*a* shows a side view of the protective cover of the present application detached from the slot car.

As shown in FIG. 3*a*, it is noted that the covering portion of the cover 100 is slanted at about 7 degrees relative to the plane of the chassis 110. By incorporating the above angle, a space 105 is formed between the cover and the chassis. The slant of the cover allows the metal brushes 101 & 102 to maintain its angle relative to the chassis at about 7 degrees, which strikes a good balance between contacting quality and amount of friction between the brushes and the metal rails on the track. The cover 100 serves another important purpose of limiting the bending angle of metal brushes 101 & 102 for avoiding fatigue due to stress concentration at the bend. This prolongs the life of the metal brushes 101 & 102 and minimizes accidental damages due to mishandle by user.

Figure 3B:
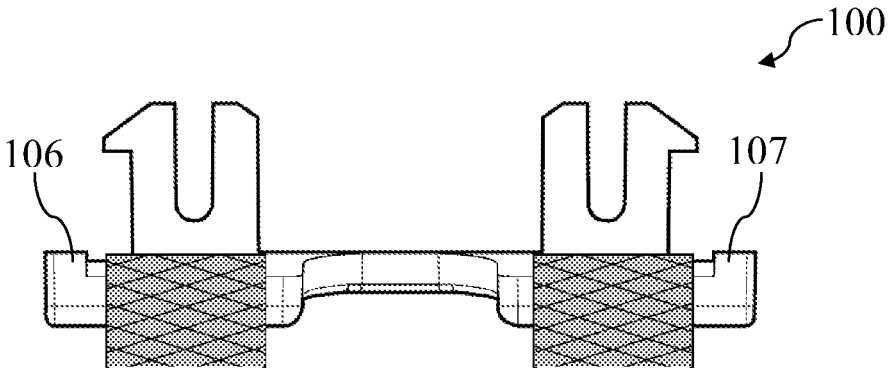
FIG. 3*b* shows an elevation view of the protective cover of the present application detached from the slot car.

Furthermore, due to the high flexibility of the metal brushes 101 & 102, the metal brushes 101 & 102 are prone to being bent sideways which affects the contact quality with the metal rails. To alleviate the above, side guides 106 & 107 are provided at the edges of the cover 100 as shown in FIGS. 2*b* & 3*b*. For a non-limiting example, the side guides 106 & 107 may be two raised steps provided on the cover 100 which serve as blockades for preventing the metal brushes to displace sideways or laterally. Side guides may be provided on both sides of the metal brush for even better effect of maintaining the metal brush in a straight position.

With the incorporation of the metal brush cover 100, the frictional contacts between the metal brushes 101 & 102 and the metal rails of the track are enhanced. Even in the circumstance that the slot cars are being handled out of the race track or being intentionally moved in a reversed direction, the metal brushes 101 & 102 are not easily deformed or damaged. By installing the abovementioned cover, issues of deformation of metal brushes are greatly reduced and thus enhancing the overall quality and re-liability of slot cars.

A non-commercial experiment involving young toddlers and less skilled individuals was conducted for the purpose of understanding how slot cars are being handled in the course of operating the same. It is not surprising for toddlers who are not familiar with slot cars, are not aware of the fragileness of the metal brushes underneath the chassis. The slot cars may be taken out of the track and being pushed in any direction by young toddlers. Slot cars with the metal brush cover installed are able to withstand the mentioned abuses and maintain operative after the experiment was conducted.

It is acknowledged according to the sales figures from the applicant that the return rates due to the deformation and damages of metal brushes reached as high as 50%-60%. The present application would contribute to the decrease of defective and return rates of slot car products.

It may be appreciated that various modifications and additions can be made to the exemplary embodiments discussed without departing from the scope of the present invention. For example, while the embodiments described above refer to particular features, the scope of this invention also includes embodiments having different com-binations of features and embodiments that do not include all of the above described features.

The invention claimed is:

1. A slot car comprising:

a chassis;

a motor mounted on the chassis for driving the slot car;

a plurality of conducting elements exposed on the chassis and electrically connected to the motor for driving the slot car, wherein each of the plurality of conducting elements is hingedly attached to the chassis; and a cover covering at least a portion of the conducting elements and being adapted to restrict the conducting elements from bending and dislocating;

wherein a substantial portion of each of the plurality of conducting elements is not covered by the cover.

2. The slot car according to claim 1, wherein each of the conducting elements is in the form of metal brush.

3. The slot car according to claim 1, wherein the cover is formed with a slanted surface so that an angle between the chassis and each of the conducting elements does not exceed 7 degrees.

4. The slot car according to claim 1, wherein the cover is further provided with a guide member, wherein the guide member restricts a lateral displacement of each of the conducting elements.

5. The slot car according to claim 4, wherein the guide member is integrally formed with the cover.

6. The slot car according to claim 1, wherein the cover is provided with fastening means for removable attachment to the chassis.

7. The slot car according to claim 6, wherein the fastening means is in a form of snap-on hooks.

8. The slot car according to claim 1, wherein the cover is integrally formed with the chassis.

9. The slot car according to claim 1, wherein the cover extends widthwise exceeding overall widths of the conducting elements.

10. The slot car according to claim 1, wherein the cover extends in a lengthwise direction of the conducting elements and covers at least ⅓ but less than half of a length of the conducting elements.

11. A slot car comprising:

a chassis;

a motor mounted on the chassis for driving the slot car;

a plurality of conducting elements exposed on the chassis and electrically connected to the motor for driving the slot car, each of the plurality of conducting elements being hingedly attached to the chassis;

a cover covering at least a portion of the conducting elements and being adapted to restrict the conducting elements from bending and dislocating, the cover comprising a plate portion; and a fastener extending from the plate portion and being configured to secure the cover to the chassis; and wherein a substantial portion of each of the plurality of conducting elements is not covered by the cover.

12. The slot car according to claim 11, wherein the plate portion comprises a slanted surface arranged so that an angle between the chassis and each of the conducting elements does not exceed 7 degrees.

13. The slot car according to claim 11, wherein the fastener comprises snap-on hooks.

* * * * *